US012433330B1

(12) United States Patent
Ramos

(10) Patent No.: US 12,433,330 B1
(45) Date of Patent: Oct. 7, 2025

(54) CIGAR HUMIDOR WITH ROTATING COMPARTMENTS

(71) Applicant: La Rumbera 1937 LLC, Miami, FL (US)

(72) Inventor: Rosie Ramos, Miami, FL (US)

( * ) Notice: Subject to any disclaimer, the term of this patent is extended or adjusted under 35 U.S.C. 154(b) by 35 days.

(21) Appl. No.: 18/372,347

(22) Filed: Sep. 25, 2023

(51) Int. Cl.

| | |
|---|---|
| ***A24F 25/00*** | (2006.01) |
| ***A24F 15/02*** | (2006.01) |
| ***A24F 25/02*** | (2006.01) |
| ***A47G 1/06*** | (2006.01) |
| ***B65D 43/16*** | (2006.01) |
| ***B65D 51/18*** | (2006.01) |
| ***B65D 51/24*** | (2006.01) |
| ***B65D 81/20*** | (2006.01) |
| ***B65D 85/12*** | (2006.01) |

(52) U.S. Cl.
CPC ..... *A24F 25/02* (2013.01); *A24F 15/02* (2013.01); *A47G 1/06* (2013.01); *B65D 43/163* (2013.01); *B65D 51/18* (2013.01); *B65D 51/245* (2013.01); *B65D 81/2076* (2013.01); *B65D 85/12* (2013.01); *B65D 2203/00* (2013.01); *B65D 2251/0021* (2013.01); *B65D 2251/0084* (2013.01); *B65D 2543/00194* (2013.01)

(58) Field of Classification Search
CPC ..... A24F 25/00; A24F 15/08; A24F 15/12; A24F 15/20; B25H 3/003; B25H 3/021; A47G 1/06; B65D 43/163; B65D 51/18; B65D 51/245; B65D 81/2076; B65D 85/12; B65D 2203/00; B65D 2251/0021; B65D 2251/0084; B65D 2543/00194
USPC ..... 206/373, 372; 312/31, 242; 131/329
See application file for complete search history.

(56) References Cited

U.S. PATENT DOCUMENTS

| | | | | |
|---|---|---|---|---|
| 2,740,683 | A * | 4/1956 | June | A24F 25/02 312/31 |
| 5,803,247 | A * | 9/1998 | Holmes | A24F 25/02 206/256 |
| 7,967,400 | B1 | 6/2011 | Collum | |
| 2012/0261042 | A1* | 10/2012 | Khubani | A45C 13/1084 150/143 |
| 2013/0220845 | A1 | 8/2013 | Smith | |

* cited by examiner

*Primary Examiner* — King M Chu
(74) *Attorney, Agent, or Firm* — Sanchelima & Associates, P.A.; Jesus Sanchelima; Christian Sanchelima

(57) ABSTRACT

A cigar humidor having rotating inner compartments for accessible storage within a humidor housing that mounts behind a picture frame. The humidor housing contains inner walls dividing the interior into separate compartments. The outer compartments include cylindrical holders with elongated openings to receive cigars aligned widthwise. The holders are attached to pivot axles enabling them to independently rotate outward for easy access to cigars. A space beneath provides clearance for rotation. The central compartment has subsections accessed by an inner lid. The humidor lid conformingly fits into the rear side of a picture frame and contains attaching features to attach and align flush with the frame back. The frame front visually obscures the humidor while providing an ornamental appearance. The humidor rotating compartments provide organized cigar storage and display concealed behind the picture frame.

5 Claims, 4 Drawing Sheets

CIGAR HUMIDOR WITH ROTATING COMPARTMENTS

BACKGROUND OF THE INVENTION

1. Field of the Invention

The present invention relates to cigar humidor and, more particularly, to a cigar humidor that has rotating compartments.

2. Description of the Related Art

The subject of the invention was broadly related to a cigar humidor. Specifically, it was related to a cigar humidor attached to the rear portion of the photo frame. The cigar humidor comprises a housing and a plurality of cigar compartments. The cigar compartments are separated from each other by the inner wall of the housing. The cigar compartments include multiple longitudinal holes to insert cigars. The central portion of each cigar compartment is pivotably attached to the inner wall of the housing, which enables the cigar compartment to rotate outwardly. The housing further includes a lid with an attaching means to receive and secure the humidor to the rear portion of a picture frame.

Applicant believes that a related reference corresponds to U.S. patent application No. 2013/0220845 A1 disclosing a personalized cigar humidor. The cigar humidor comprises a wood-lined interior for cigars, a hinged lid with fastening elements, and a graphic or textual sheet. A removable frame with a transparent window aligns with the sheet and attaches via fastening elements on the lid, allowing a view of the graphic. Applicant believes that another related reference corresponds to U.S. Pat. No. 7,967,400 disclose a wall-mounted cigar humidor. The wall-mounted cigar humidor comprises storage trays and closure members pivotally connected with the storage trays by hinges. The closure member comprises a personal cabinet for framed pictures, paintings, or other pieces of artwork. None of these references, however, teach of a central portion of the compartment pivotally attached within the inner sections of the humidor to rotate the compartment outwardly at a predetermined angle.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to incorporate the humidor into an existing picture frame creates a unified look. The frame can also enhance the visual appeal of the humidor with decorative moulding, painting, etc. This improves aesthetics compared to a plain humidor.

It is another object of this invention to provide a cigar humidor with rotating compartments, wherein the compartments rotate independently to allow easy access to any cigar without having to move the entire frame or remove it from the wall. This provides convenient retrieval from any housed cigar.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
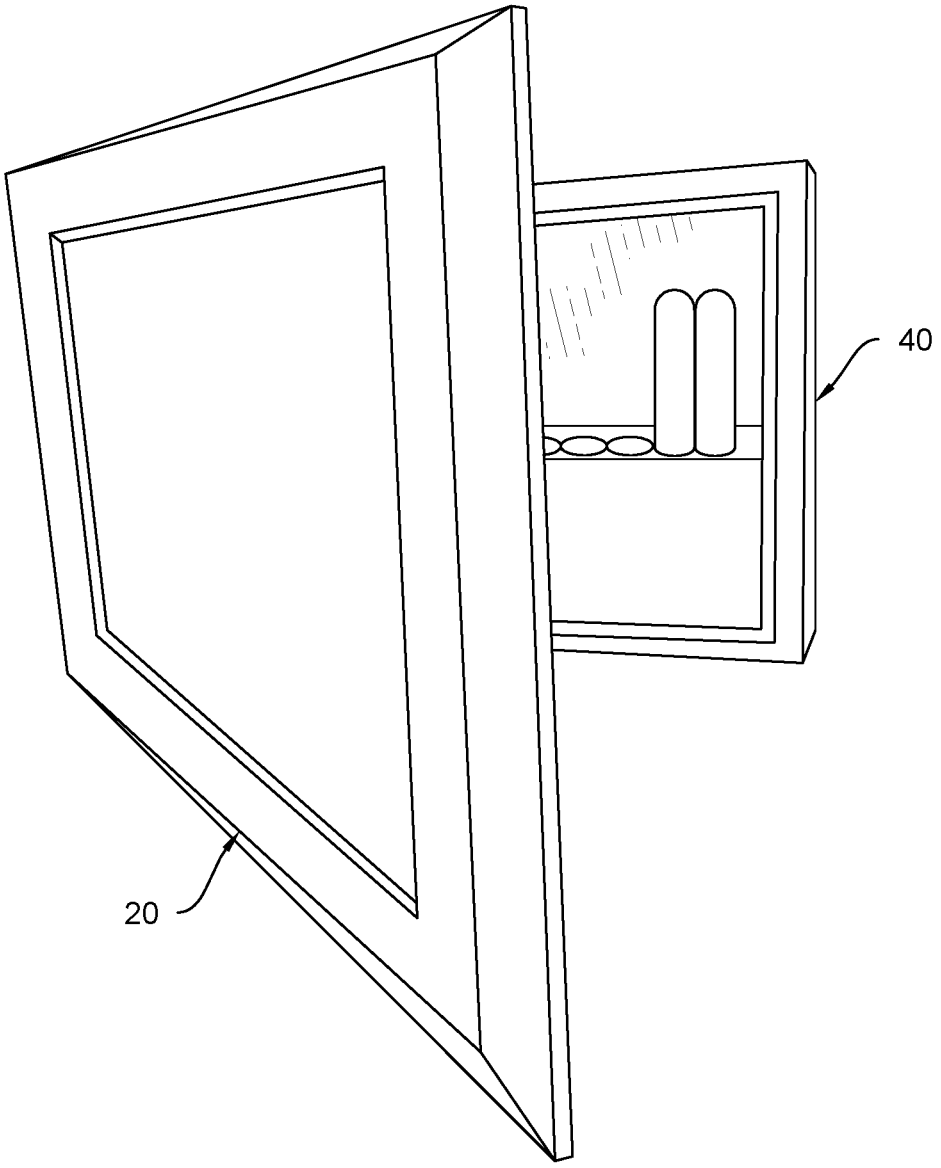
FIG. 1 represents an operational view of the present invention in one exemplary embodiment.

Referring now to the drawings, where the present invention is generally referred to with numeral 10, it can be observed that it basically includes a frame 20, a humidor 40 and holders 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
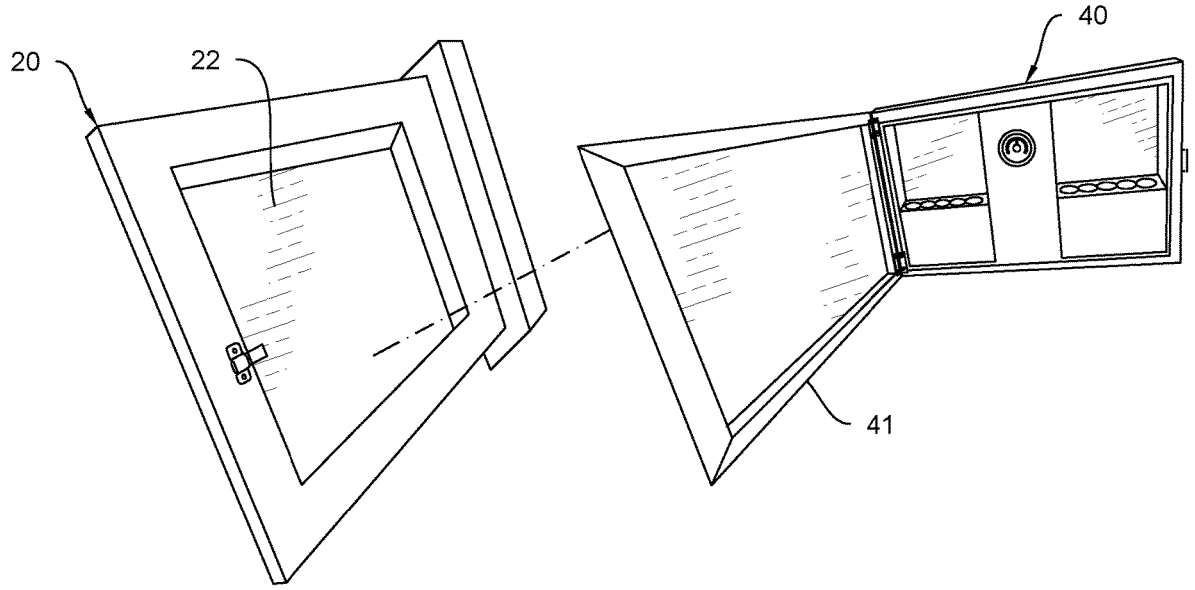
FIG. 2 shows an exploded view of the frame 20 with respect to the humidor assembly 40.
Figure 3:
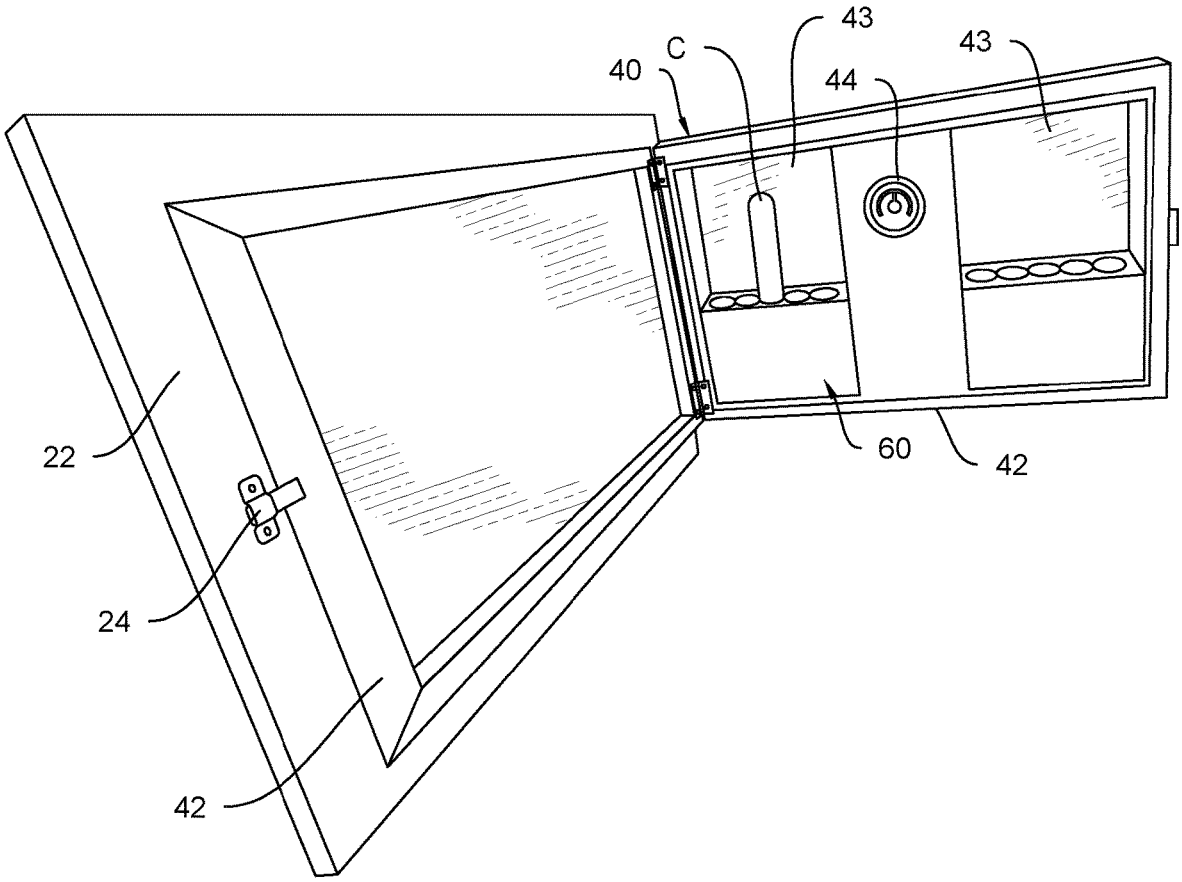
FIG. 3 illustrates a perspective view of the humidor assembly 40 connected to the rear side of the frame 22, wherein the humidor houses the holders 60.

According to one exemplary embodiment, the frame 20 may have 4 sides defining a cuadrangular or rectangular shape. In a preferred embodiment, said frame may be a picture frame. In various embodiments, said frame 20 may be made of wood, metal, ceramics, natural or synthetic fibers, polymers, or any other suitable material as known in the art. In a preferred embodiment, the frame 20 may have lowered area on the frame rear defining a rear side 22. As shown in FIG. 2, the frame 20 may include securing means 24 at the rear periphery thereof. It should be noted that said securing means may be a security slide latch, a barrel slide bolt, a deadbolt lock, a bendable tab, or any suitable variation thereof, that permits to secure a device against the rear side 22.

Figure 4:
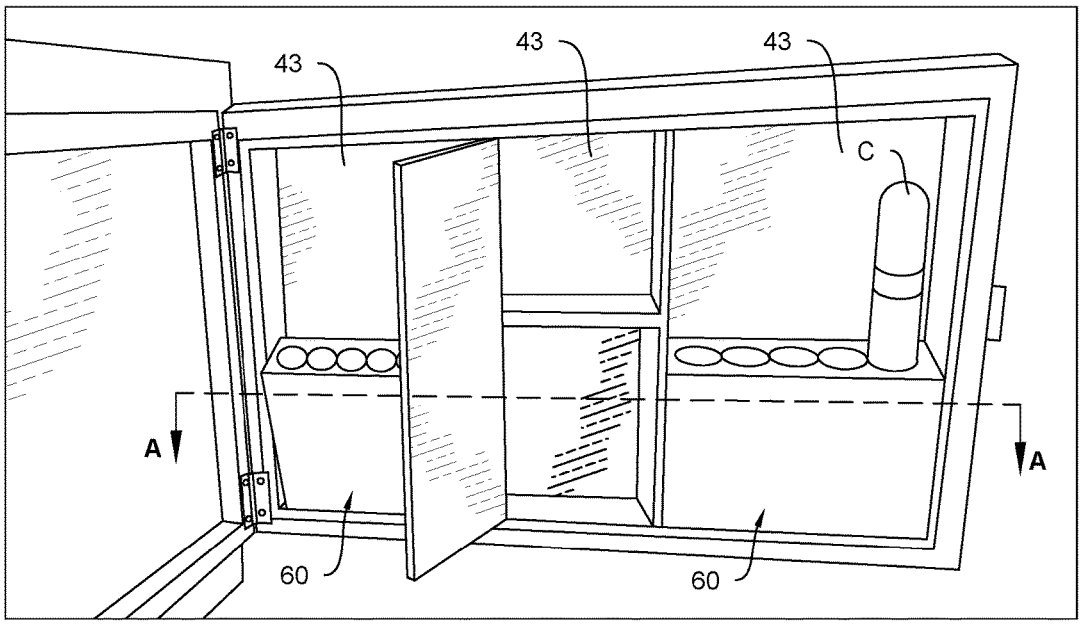
FIG. 4 is a representation of a front perspective view of the humidor 40 with cross section lines A-A.

As illustrated through fires 2-5, the humidor 40 comprises a box-like container having a generally rectangular prism geometry with six sides. The humidor 40 is sized to partially fit within the rear side 22 dust cover of the picture frame 20. The humidor 40 can be constructed of materials suitable for maintaining internal humidity levels optimal for cigar storage, such as wood, acrylic, metal or plastic. In one embodiment, the humidor is made of Spanish cedar wood which regulates humidity. The top side of the humidor 40 consists of a lid 41 that is hingedly attached along one side to the upper edge of one of the vertical side panels. This allows the lid 41 to pivot open for accessing the interior of the humidor 40. When closed, the lid 41 is flush with the back of the frame 20 and conformingly fits within the dust cover space. The bottom side of the humidor 40 consists of a base 42 that supports the four vertical side panels. The base 42 is positioned opposite the lid 41 on the bottom of the humidor 40 structure. The front, back and two side vertical panels are attached at their lower edges to the base 42 and at their upper edges to the lid 41 to create the box shape. The rear panel may include features for mounting flush to the frame. The humidor 40 further includes inner walls 45 positioned within the interior space that define multiple storage sections 43. In a preferred embodiment, the inner walls 45 divide the interior into three rectangular sections-two outer lateral sections and one central section between the lateral ones. As depicted in FIG. 4, the two lateral sections contain rotating compartments 60 for organized cigar storage. The compartments 60 can independently rotate to allow access to cigars C stored therein. The central section has an inner lid 46 that enables access to additional storage subsections inside. In a preferred embodiment, the central section is divided into two subsections by an additional inner wall 45. In one preferred embodiment, a hygrometer 44 is attached to the inner lid 46 for monitoring humidity levels in the central section. Alternatively, the hygrometer 44 may be positioned in other viable locations within the interior of the humidor 40.

Figure 5:
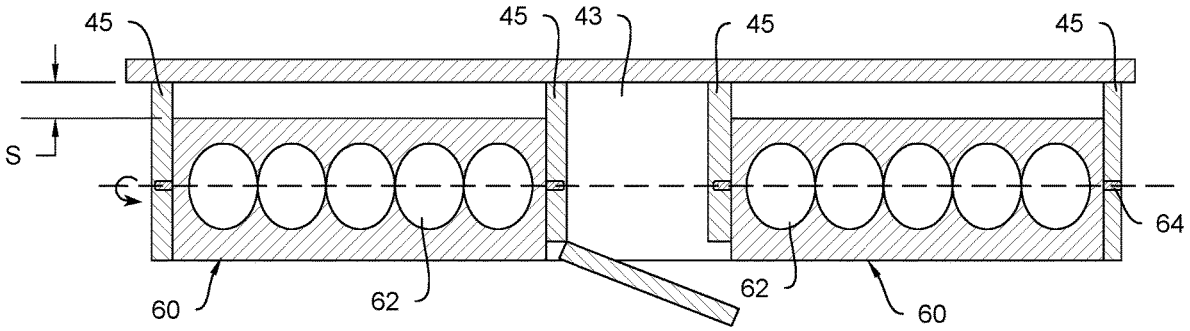
FIG. 5 depicts a cross sectional view of the humidor 40 from section lines A-A.

The humidor 40 contains cigar holders 60 that are positioned within the lateral storage sections. The holders 60 have a geometry of open framed rectangular structures sized to fit within the lateral sections. The holders 60 may be constructed of materials optimal for cigar storage, such as Spanish cedar or wood. The holders 60 include multiple cigar compartments 62 which are elongated openings that longitudinally traverse through the holders 60 at a depth configured to receive various cigar types. In a preferred embodiment as shown in FIG. 5, the cigar compartments 62 align collinearly along the width of the holders 60. This enables organized storage of multiple cigars accessibly in a row. Between the base 42 of the humidor 40 and the rear of the holders 60 is a space S which provides clearance for the holders 60 to rotate. Without this space S, the holders 60 would be in abutting contact with the base 42, preventing rotation, such a configuration is better shown in FIG. 5. Pivot members 64 extend laterally from the sides of the holders 60 and are received into the adjacent lateral walls of the humidor 40. The pivot members 64 act as axles enabling the rotating motion of the holders 60 for accessible cigar storage and display.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A cigar humidor with rotating compartments, comprising:

a) a humidor housing having inner walls dividing interior space into separate compartments, including lateral compartments and a central compartment, wherein the central compartment includes an inner lid for accessing subsections within the central compartment; wherein a hygrometer is attached to the inner lid of the central compartment;

b) cigar holders positioned within the lateral compartments, the holders including elongated openings to receive cigars and pivot members enabling rotation of the holders;

c) said cigar holders having a central portion pivotally attached to an inner wall of the humidor to enable outward rotation at a predetermined angle for accessing contents;

d) a humidor lid configured to conformingly fit within a rear side dust cover of a picture frame.

2. The cigar humidor of claim 1, wherein the elongated openings of the cigar holders are aligned collinearly along the width of the holders.

3. The cigar humidor of claim 1, further comprising a space between a base of the humidor housing and a rear side of the cigar holders to provide clearance enabling rotation of the holders.

4. The cigar humidor of claim 1, wherein the humidor housing is constructed of a material for maintaining humidity levels.

5. A cigar humidor with rotating compartments, comprising:

a) a rectangular humidor housing constructed of a material suitable for maintaining humidity levels, the housing having inner walls dividing the interior into two lateral compartments and a central compartment between the lateral compartments;

b) a humidor lid hingedly attached to an upper edge of the housing and configured to conformingly fit within a rear side of a picture frame;

c) a base positioned opposite the lid to support vertical side panels of the housing;

d) cigar holders rotatably positioned within each lateral compartment, the holders having elongated compartments aligned widthwise to receive cigars and pivot members on a central portion enabling rotation of the holders, a space between the base and cigar holders providing clearance for rotation of the holders;

e) the central compartment containing an inner lid and subsections.

* * * * *